United States Patent [19]

Lotosh et al.

[11] 4,049,435

[45] Sept. 20, 1977

[54] METHOD FOR OBTAINING A LUMP PRODUCT

[76] Inventors: Valery Efimovich Lotosh, ulitsa Chkalova, 34; Vladimir Demyanovich Steblyak, ulitsa Shmidta, 76, kv. 32, both of Sverdlovsk, U.S.S.R.

[21] Appl. No.: 679,359

[22] Filed: Apr. 22, 1976

[51] Int. Cl.[2] ..... C22B 1/08

[52] U.S. Cl. ..... 75/3; 75/7; 75/114

[58] Field of Search ..... 75/1, 3, 4, 5, 6, 7, 75/25, 114

[56] References Cited

U.S. PATENT DOCUMENTS

| | | | |
|---|---|---|---|
| 1,858,274 | 5/1932 | Kern et al. | 75/3 |
| 2,756,136 | 7/1956 | Queneau | 75/7 |

FOREIGN PATENT DOCUMENTS

| | | |
|---|---|---|
| 339,583 | 8/1972 | U.S.S.R. |

*Primary Examiner*—L. Dewayne Rutledge
*Assistant Examiner*—Michael L. Lewis
*Attorney, Agent, or Firm*—Lackenbach, Lilling & Siegel

[57] ABSTRACT

The proposed method relates to preparation of ores and is intended for production of pellets and briquettes with use being made of mineral hydraulic binders.

This method comprises mixing an ore with a mineral hydraulic binder, the mixture obtained is simultaneously homogenized and activated, then said mixture is pelletized and the green lumps are subjected to a heat humidity treatment at 70–100% relative humidity and a temperature of 60°–250° C followed by a two-stage heat treatment, the first stage of said treatment being effected at 70°–100° C until there is a 2–5% content of free moisture in the lumps, and the second stage of heat treatment being effected at a temperature of no less than 100° C and no more than 900° C until there is 0.01–1.0% content of free moisture in the lumps.

5 Claims, No Drawings

METHOD FOR OBTAINING A LUMP PRODUCT

The present invention relates to preparation of ores, and more particularly to production of pellets and briquettes with use being made of mineral hydraulic binders (cements). The invention can be also employed for pelletizing ores, concentrates, dusts, slimes and similar materials used in ferrous and nonferrous metallurgy, as well as in the chemical industry.

At present, the main operation of strengthening pellets and briquettes during production thereof is calcination at a temperature of 1200° to 1300° C. The strengthening in this case occurs due to sintering and partial fusing of the pellets. Disadvantages of the prior art methods of calcinated pellet production are the enormous capital expenditures involved in the construction of a production facility, high cost and operating expenses involved in the conversion of lumps and considerable pollution of the environment with calcination products.

Low-temperature strengthening methods have substantially helped to eliminate the disadvantages in the production of calcinated pellets. These methods provide for strengthening of lumpy products (pellets and briquettes) by the use of various binders introduced into the charge rather than by sintering and partial fusing of lumps.

Of all the low-temperature methods for strengthening pellets and briquettes, those making use of mineral hydraulic binders, hereinafter referred to as 37 cements," have found the widest commercial application.

Known in the art among the low-temperature metallurgical charge pelletizing methods employing portland cement-type binders. The first experiments to obtain briquettes from iron ore materials with the employment of 3-6% portland cement as the binding agent were made by L. Yuzbashev in 1889. Yet, the realization of this method of making briquettes from iron ore material encountered considerable difficulties in industry due to briquettes sticking to one another when in storage. The technology of the "Grengesberg" developed and commercially realized by a Swedish firm provides for the production of pellets with binders of the portland cement-type and pouring a concentrate over said pellets at the initial stage of strengthening (18-30 hours) to preclude sticking of the lumps. However, strengthening at normal temperatures to produce a quality product may take as long as 4 weeks.

Also known in the art are methods of autoclave strengthening of charges with use being made of portland cement-type binders, slaked lime, etc. The strengthening time while autoclaving the pellets is several hours and the steam pressure if 8-12 atm. A serious disadvantage of the autoclave method is its being discontinuous, which hinders its implementation on a large scale. Besides, these methods require more sophisticated and costly equipment as compared to other cold-bound methods. For the above reasons, the autoclave method is used on a relatively small scale, only in nonferrous metallurgy (The Mednogorsk Copper-Sulfur Works, USSR).

Also known is a method of producing self-hardening pellets and briquettes comprising an iron ore material, cement, fuel and moisture, which involves maintaining granules of ore for 6-8 hours in an atmosphere with a 70-100% relative humidity and a temperture of 70-95° C, followed by subsequent air drying first at temperatures of 70°-95° C, then at 125°-140° C, each drying cycle being 45-60 min (cf. USSR Inventor's Certificate No. 339 583). This method was disclosed in 1970 under the name "Method of Accelerated Hardening." It comprises two hardening operations. The first operation consists in heat-humidity treatment of pellets and briquettes (temperature: 70°-95° C, relative humidity of the ambient medium: 70-100%. The second operation consists in drying the lumps in two stages, the maximum drying temperatures (at the second stage) being 125°-140° C.

The method of accelerated hardening has a number of advantages over the methods of hardening of pellets and briquettes at normal temperatures and over the autoclave strengthening method. The increase in the humid medium temperature from a normal temperature of (15°-20° C) to 95° C makes it possible to cut down the briquette hardening time from 336 to 10 hours, i.e. more that 30-fold, and that of pellets, from 168 hours to 8 hours, i.e. more than 20-fold (the strength being equal). The use of subsequent 2-stage drying according to the above conditions, leads to an additional increase in the lumps ' strength by 12-35%. At the same time, sticking of pellets and briquettes is eliminated owing to a drastic acceleration of the transfer of free moisture into a chemically combined state. As distinguished from the autoclave method, both operations of strengthening in the accelerated hardening method occur under normal ambient pressure, which provides for a continuous and economical process of producing pellets and briquettes comparable in strength to that of the autoclave method.

Yet, the accelerated hardening method according to U.S.S.R. Inventor's Certificate No. 339 583 has certain disadvantages diminishing the effect of its application. A disadvantage of this method is a comparatively low degree of strengthening of the lumps at the drying stage. The method does not permit efficient strengthening of the pellets with a low initial strength since such pellets, when heated to the heat-humidity treatment temperature, are liable to destruction (cracking). Also the lumps's strength is insufficient when use is made of low-quality mineral hydraulic substances. Besides, the accelerated hardening method according to Inventor's Certificate No. 339 583, just like other methods of low-temperature strengthening of pellets and briquettes, does not permit removal of sulfur, i.e. desulfuration, which essentially limits the scope of application thereof in lumping iron ore and other materials.

It is an object of the present invention to provide a method for obtainings a lump produce, whereby heat treatment is effected so as to increase the strength of the finished product.

Another object of the invention is to provide a method for obtaining a lump product, which will make it possible to reduce the time of hardening of the finished product.

These and other objects are attained in a method for obtaining a lump product from a charge with components less than 1 mm in size, comprising the steps of mixing the charge components with a mineral hydraulic binder, the obtained mixture is simultaneously homogenized and activated, the homogenized and activated mixture is pelletized to obtain green lumps, whereafter the latter are strengthened by a heat-humidity treatment in a medium with a relative humidity of 70-100% at a temperature of 60°-250° C followed by a subsequent two-stage heat treatment to obtain a finished product in the form of pellets or briquettes. According to the invention, the first stage of heat treatment is effected at 70°–100° C until the strengthened lumps contain 2–5% of free moisture, and the second stage is effected at a temperature of at least 100 and at most 900° C until a 0.01–1.0% free moisture content is obtained.

The two-stage heat treatment in accordance with the invention permits an increase in the pellet's strength, at the first stage, by 10–20% and, at the second stage, by 60–80%, which is much higher than in the prior art method. This is achieved by optimizing the transition from the first stage of heat treatment to the second, and by a higher temperature at the second stage. An earlier transition from the first stage of heat treatment to the second, wherein the content of free moisture is more than 5%, gives rise to rapid evaporation of a large amount of free moisture from the samples, which, in turn, leads to partial destruction of their structure and results in a 20–30% decrease in the strength of the lumps as compared to the two-stage heat treatment of the present invention. Transition from the first to the second stage of heat treatment, where the free moisture content is less than 2%, leads to an increase in the total time of heat treatment. A rise in temperature at the second stage of heat treatment up to 900° C essentially intensifies the processes of drying and solid-phase sintering of pellets and briquettes so that for a period of time comparable to the duration of the second stage of drying in the prior art method makes it possible to substantially enhance the strength of lumps as compared to the above-mentioned method.

The content of free moisture at which transition from the first to the second stage of heat treatment takes place, depends upon the chemical composition of the charge to be lumped, quality of parent lumps, and, for the most part, upon relative humidity which is maintained during the stage of heat-humidity treatment. When the relative humidity during the heat-humidity stage is about 70%, the free moisture content of the lumps should be about 2% before transition from the first to the second stage of heat treatment takes place. When the relative humidity during the heat-humidity stage is about 100%, the free moisture content of the lumps should be 5% before transition from the first to the second stage of heat treatment takes place.

The present method also enables desulfuration of lumps, for which purpose the pellets and briquettes, having sulfur-containing materials, after their heat-humidity treatment, are treated with an aqueous solution of chlorides or hydrochloric acid, and the second stage of heat treatment is effected at a temperature of at least 400° C to remove sulfur. The presence of sulfur in pellets and briquettes pollutes the metal being smelted, which involves considerable additional expenses for its desulfuration in a blast furnace or for its purification outside the blast furnace.

The desulfuration treatment of pellets and briquettes after the heat-humidity treatment makes it possible to avoid a reduction in the lumps' strength, which occurs when chlorides or solutions thereof are introduced into the charge or initial samples, since, as indicated by experiments, said additives impair the strength. When the temperature of the second stage of heat treatment rises above 400° C, chlorides interact with sulfur compounds to from easily subliming primary sulfur-containing compounds of the sulfur chloride-type, and elementary sulfur, which leads to a decrease in the sulfur content in the product being pelletized. Elementary sulfur in an oxidizing atmosphere is also removed. The interaction of chlorine- and sulfur-containing compounds does not occur intensively enough, and the degree of desulfuration in this case is insignificant.

The present method makes it possible to substantially strengthen pellets having low initial strength. For this purpose, while strengthening green pellets having an initial compressive strength of less than 2.0 kg, with a cement binder, they are exposed to air prior to heat-humidity treatment, until the cement binder starts setting. In the course of this exposure, hereinafter referred to as preliminary aging, the pellets' strength grows and part of the free moisture is bound and evaporates. During subsequent heating at the heat-humidity treatment stage, the pellets are capable of resisting destruction due to overmoistening caused by steam condensation on their colder surface.

The duration of the preliminary aging depends not only on the properties of the binder, but also on the relative humidity of the ambient medium. In an air-humid medium (relative humidity: 90–100%), the duration of this operation is determined by the end of setting of the mineral hydraulic binder. Longer duration of preliminary aging in the air-humid medium is due to the fact that in this medium the process of removing free excess moisture is difficult.

The method of determining the beginning and end of the setting of the mineral hydraulic binder is well known in the art.

Besides, the present method permits production of pellets and briquettes of a higher strength with mineral hydraulic binders of low quality. For example a mineral hydraulic binder with a compressive strength of less than 350–450 kg/cm and aged for 28 days, is activated mechanically prior to introduction into the charge, the specific surface being increased ty 10–15%. Mechanical activation leads to an increase in the number of surface defects in the structure of the binder with the result that chemical activity and quality thereof increases substantially. At the same time, an increase in the specific surface of the mineral hydraulic binder occurs.

The proposed method of accelerated hardening of pellets and briquettes includes the following steps: preparation of the charge, pelletizing the charge into lumps, preliminary aging of the lumps, heat-humidity treatment thereof, as well as treatment with a chloride solution (hydrochloric acid), and heat treatment. The finished product is obtained in the following way.

An ore component to be pelletized is mixed with a mineral hydraulic binder which, in case of insufficient chemical activity, is subjected to preliminary mechanical activation with the specific surface increasing by 10–15%. The stirred charge is activated mechanically by means of disintegrators, mills, edge runner mills and other similar devices, then is lumped to produce pellets and briquettes. The charge activation is considered sufficiently activated when its specific surface increases by 300–500 $cm^2/g$.

For pelletization, the moisture content in the homogenized charge should be below the optimum level, the rest of the water together with additives, namely, regulators of hardening of the mineral hydraulic binder, are fed for granulation. Depending on the type and quality of cements, the composition of the ore part and the requirements of the metallurgical properties of pellets the consumption of the binder constitutes 5–15%.

Green pellets with an initial compressive strength of less than 2.0 kg get the preliminary aging treatment, whereas those with higher strength, go directly to the heat-humidity treatment. Preliminary aging can be effected in floor-type storehouses, at conveyor installations arranged in front of or inside the heat-humidity treatment chambers. The height of a layer of pellets may be within 1.5–3.0 m. In air, the duration of preliminary aging is determined, when the cement binder has begun to set, and in an air-humid medium, when the cement binder has completed setting.

The heat humidity treatment is effected in an atmosphere with a relative humidity of 70–100%, which prevents evaporation of water from the lumps. The combination of an elevated temperature with a sufficient amount of moisture sharply accelerates the hydration of the cement binder. The temperature of the heat-humidity treatment is usually 60–100° C, which makes it possible to carry out this treatment under normal ambient pressure. Heat-humidity treatment at a temperature of more than 100° C and under normal ambient pressure is known as steaming. Its duration is several hours. Steam consumption in an amount of 8–10%, of the charge weight, is used to provide the required humidity and also serves as a heat carrier gas. Alternatively, the pellets and briquettes may be "self-steaming." In this case, their heating is effected with the aid of heating elements, and the moisture content in the material being pelletized is maintained by limiting the space wherein moisture is evaporated. For steaming it is possible to employ tunnel, annular and other types of chambers which operate continously and are built of brick or concrete. Used as the means for transporting pellets and briquettes are conveyors or trolleys, the height of the layer of the loaded material being 1.0 to 1.5 m.

The present method provides for not only steaming as a possible alternative of heat-humidity treatment, but also autoclave strengthening of pellets and briquettes using prior art methods.

Further increase in the lumps' strength after steaming or autoclaving is achieved by heat treatment at a temperature from 70° to 900° C. The best results were obtained with two-stage heat treatment, the first stage being carried out at 70°–100° C to a 2–5% free moisture content in the product being strengthened, while the second stage is carried out at a temperature of 100°–900° C to a 0.01–1.% free moisture content.

For materials which do not contain sulfur, the preferred temperature range of the second stage of heat treatment is 100° to 400° C, and its duration is 0.25 to 2.0 hours. In case materials are to be pelletized from which sulfur should be removed, the second stage of heat treatment is effected at 400°–900° C for 10–90 min. In thise case, after the heat-humidity treatment (steaming or autoclaving), the lumps are treated with an aqueous chloride solution such as hydrochloric acid. The treatment is effected by dipping the pellets and briquettes into the solution or by sprinkling them with the latter. Heating the solution up to 60°–100° C increases the critical concentration of the chloride ion in the solution and, consequently, in the lumps being treated. The amount of the absorbed solution is usually 2–8% or, calculated with respect to the chloride ion, 0.4–7% (in the saturated solution). Saturation of lumps takes 3–20 min, after which the lumps undergo heat treatment.

The heat treatment can take place in such conventional apparatus as tubular, shaft and other furnaces or in special apparatus making it possible to consecutively carry out the heat-humidity and heat treatment steps.

The present method of accelerated hardening of products has been tested in pelletizing magnetite, hematite, hydrogoethite iron ore concentrates, slimes and scale of the metallurgical process, sulfide concentrates and ores of non-ferrous metals, chromite and phosphorite ores and some other materials. Portland cement and portland-cement clinker ground to a preset degree of dispersion, portland slag-cement, blast furnace slags with additions of hardening agents, slaked lime and a number of special cement binders have been tested and proved to be good mineral hydraulic binders.

Given below are specific examples of carrying out the proposed method for pelletizing various loose substances. The chemical composition and degree of dispersion of the materials described in the Examples are given in Table 1, and test results are given in Table 2.

EXAMPLE 1

Magnetite concentrate of the Kachkanarski deposit and portland cement taken in a 10 to 1 ratio were activated in a rod mill. The charge was pelletized in a drum granulator to obtain green pellets having an initial compressive strength of 2.82 kg. As soon as they were produced, the pellets were subjected to heat-humidity treatment (steaming) at 90°–100° C and 70 –90% relative humidity. After six hours of steaming, the strength of the pellets 16–18 mm in diameter reached 79.5 kg. and the content of free moisture therein was 3.0%. Then, the pellets were dried for 15 min at 95°–100° C with the result that their moisture content dropped to 2.0%. After that, the pellets were heated to 200° C and kept at this temperature for 60 min. The moisture content in the dried up pellets was less than 0.3% and their strength, determined as the average for ten samples, reached 139 kg.

EXAMPLE 2

Parent pellets taken from test I were steamed at 90–100% relative humidity and a temperature of 95°–100° C. After six hours of steaming, their strength reached 89.5 kg, and the content of free moisture was 6.5%. Then, the pellets were dried for 15 min at a temperature of 95°–100° C with their moisture content going down to 5.0%. After that, the pellets were heated to 200° C and kept at this temperature for 60 min. The moisture content in the dried pellets was less than 0.3% and their strength increased to 150 kg.

EXAMPLE 3

Pellets which were obtained, steamed and dried at the first stage of heat treatment as specified in Example 1 were then subjected to the second stage of heat treatment at 100° for 60 min. The strength of the finished pellets was 110 kg and their moisture content was about 1.0%.

EXAMPLE 4

Pellets obtained, steamed and dried at the first stage of heat treatment as specified in Example 1 were subjected to the second stage of heat treatment at 400° C for 30 min. The Finished pellets' strength was 160 kg, and their moisture content was less than 0.1%.

EXAMPLE 5

Pellets from magnetite concentrate of the North-Peschansk deposit (90%) and portland cement clinker (10%), ground to a specific surface of 4000 $cm^2/g$, were prepared and steamed as specified in Example 1 to obtain a strength of 35 kg (14–16 ) mm diameter). Then, they were dipped for 15 min into a hydrochloric acid solution and subjected to the second stage of heat treatment for 1.5 hours at 600° C. After 0.4% of hydrochloric acid was spent, the sulfur content decreased from 0.39 to 0.16% (desulfuration degree of 59%), and the pellets' strength was 117 kg.

EXAMPLE 6

The test was carried out as specified in Example 5 with the difference that the temperature of the second stage of heat treatment was 900° C. The content of sulfur in the pellets was 0.17%, and their strength was 88.5 kg.

EXAMPLE 7

Pellets were obtained, steamed and subjected to heat treatment as specified in Example 1 with the difference that prior to steaming they lets were exposed to air.

| Duration of preliminary aging, hrs. | 0 | 2 | 4 | 6 | 8 |
|---|---|---|---|---|---|
| Final strength of pellets, kg | 120 | 155 | 155 | 160 | 180 |

As can be seen from the above, the strength of the pellets increased with the duration of preliminary aging being two and more hours. This time is close to the beginning of setting of the cement binder, which is 1 hour 35 min.

EXAMPLE 8

Pellets with an initial strength of 1.98 kg were subjected to the treatment specified in Example 1, reaching a final strength of 85 kg. Some pellets cracked during heating at the steaming stage. The same pellets were strengthened as specified in Example 7 with a two hour aging. Their final strength was 120 kg, none of the samples cracked.

EXAMPLE 9

Pellets were obtained, steamed and subjected to heat treatment as specified in Example 1 with the difference that prior to steaming they were aged in an air-humid medium (90–100% relative humidity).

| Duration of preliminary, Aging, hrs. | 0 | 2 | 4 | 6 | 8 |
|---|---|---|---|---|---|
| Final strength of pellets, kg | 120 | 110 | 140 | 145 | 200 |

As can be seen from the above, there occurs a drop in the strength of the pellets in the case of preliminary aging lasting 2 hours due to over moistening of the parent pellets and their weakening as a result of this process. However, after a four-hour preliminary aging in a humid medium, the pellets' final strength exceeds their strength without preliminary aging. This duration, taking into account the time necessary for the preparation of the charge and the latter's pelletization, is close to the end of setting of the cement binder (5hours 10 min). Eventually, preliminary aging in a humid medium shows better results of strengthening than preliminary aging in air (cf. Example 7).

EXAMPLE 10

Pellets were obtained, steamed and subjected to heat treatment as specified in Example 1, with use being made of portland cement with a 400 kg/cm² activity. The strength of the parent pellets was 1.61 kg and their final strength was 65 kg. In another test, portland cement was first activated, with its specific surface increasing by 15% (relative), then strengthened as specified in Example 1. The pellets' initial strength was 2.58 kg, while the final strength was as high as 135 kg.

EXAMPLE 11

Dusts and slime from blast furnace, open-hearth and converter production, roll scale and other metallurgical waste were pelletized with a mixed cement binder, the silica content in the latter varying from 2.0 to 30%. After steaming and heat treatment as specified in Example 1, the pellets had a final strength of up to 130 kg with a diameter of 14–16 mm.

When conventional portland cement binders were used, the strength of pellets made from the above materials did not exceed 30–40% of the above-mentioned one.

EXAMPLE 12

Magnetite concentrate of the Kachkanarsk deposit and portland cement clinker taken in a 10 to 1 ratio were mixed with 1 part by weight of water, activated in a mortar, then, with a 570 kg/cm² force being applied, briquettes 20 mm in diameter and height were made from the charge. Further, the briquettes were strengthened as specified in Example 1. The strength of a briquette after steaming was 58.0 -63.0 kg/cm², and after heat treatment it increased to 95–105 kg/cm².

Thus, the proposed method of accelerated hardening exhibits a number of advantages over autoclave methods and over hardening at normal temperatures. Unlike the autoclave hardening, the accelerated one is effected in a humid medium under normal pressure, which makes it possible to ensure a continuous process of strengthening pellets making use of cheap brick and concrete aggregates. The time of hardening of pellets according to the "steaming plus heat treatment" method is comparable to the autoclave strengthening time.

The realization of the method of accelerated hardening, including autoclaving and heat treatment, enables one to cut down the consumption of the binder or the duration of autoclaving 1.5–2 times.

The present method cuts down 50–100 times and more the pellets strengthening time as compared to the methods of strengthening at normal temperatures. In particular, in the case of a six hour steaming cycle, the achieved strength equals that attained after one week by the "Grengesberg" method. After heat treatment, the pellets strength reaches that attained after one month by the Grengesberg method. Heat-humidity treatment prevents sticking of pellets, thereby dispensing with necessity of sprinkling them with a concentrate.

Besides, the present method of accelerated hardening essentially expands the scope of application of cold-bound pelletizing, since it is the only one of all the prior art methods which enables desulfuration of pellets.

Pellets produced by accelerated hardening possess high metallurgical properties. Linder tests have shown that the reducibility of samples 10–20 mm in diameter was 40–75%, the yield of minus 0.5 mm class was 1–5%, and that of +5mm was −95–99%. The pellets were not broken in the upper portion of the charge of the blast furnace. Their abradability in a cold state, as revealed by testing in a drum, did not exceed 8–10%.

TABLE 1

CHEMICAL COMPOSITION AND DEGREE OF DISPERSION OF MATERIALS USED IN EXAMPLES

| Type of Material | Composition of Elements, percent | | | | | | | | | |
|---|---|---|---|---|---|---|---|---|---|---|
| | Fe | $Fe_2O_3$ | FeO | CaO | MgO | $SiO_2$ | $Al_2O_3$ | S | impurities | Specific surface, $cm^2$ |
| | | | | | | by weight | | | | |
| Magnetite concentrate of the Kachkan ark deposit | 62.5 | 60.4 | 26.1 | 1.33 | 2.69 | 3.53 | 2.65 | 0.01 | 0.96 | 1200 |
| Magnetite concentrate of the North-Peschansk deposit | 68.55 | 66.0 | 28.8 | 0.86 | 0.22 | 1.90 | 0.89 | 0.39 | 0.40 | 1350 |
| Blast furnace dust | 41 to 44 | 56.6 | 9.16 | 7.72 | 4.89 | 7.34 | 3.00 | 0.28 | 8.57 | 1100 |
| Blast furnace slimes | 42.15 | 54 | 5.66 | 7.14 | 3.50 | 10.24 | 3.96 | 0.22 | 12.24 | 3000 |
| Converter process slimes | 58.3 | 79.6 | 3.35 | 5.78 | 0.29 | 1.40 | 0.19 | 0.07 | 4.00 | 3000 |
| Portland cement | 2.85 | 3.93 | 0.12 | 59.6 | 1.54 | 25.9 | 5.0 | 0.80 | 1.64 | 3600-3800 |
| Portland cement clinker | 4.10 | 5.56 | 0.27 | 62.4 | 2.08 | 22.1 | 5.0 | 0.10 | 0.76 | 4000-4300 |
| Combined cement binder | | | | | | 2-30 | | | | 4000-7000 |

TABLE 2

MAIN CHARACTERISTICS OF PELLETS IN THE TESTS ILLUSTRATED BY EXAMPLES

| Example No. | Main characteristics of pellets (briquettes) | | | | | |
|---|---|---|---|---|---|---|
| | compressive strength, kg | | free moisture content, % | | | desulfuration degree, % |
| | | | after steaming | after heat treatment | | |
| | steamed | dry | | 1st stage | 2nd stage | |
| Example 1 | 79.5 | 139 | 3.0 | 2.0 | 0.3 | |
| " 2 | 89.5 | 150 | 6.5 | 5.0 | 0.3 | |
| " 3 | 79.5 | 110 | 3.0 | 2.0 | 1.0 | |
| " 4 | 79.5 | 160 | 3.0 | 2.0 | 0.1 | |
| " 5 | 35 | 117 | 3.0 | 5.0 | 0.01 | 59.0 |
| Example 6 | 35 | 88.5 | 3.0 | 5.0 | 0.01 | 56.5 |
| " 7 | 114-132 | 155-180 | 3.0 | 2.0 | 0.3 | |
| " 8 | 70 | 120 | 3.0 | 2.0 | 0.3 | |
| " 9 | 101-144 | 140-200 | 3.5 | 2.5 | 0.3 | |
| " 10 | 85 | 135 | 3.0 | 2.0 | 0.3 | |
| Example 11 | 40.5 | 131 | 4.2 | 3.8 | 0.2 | |
| Example 12 | 58-63 | 95-105 | 3.0 | 2.0 | 0.1-0.3 | |

What is claimed is:

1. A method for preparing a strengthened pelleted ore product, which comprises an ore of less than 1 mm in size with a hydraulic binder, simultaneously homogenizing and activating the mixture, pelleting the mixture to obtain green pellets, steaming the green pellets at a temperature of 60°-250° C and a relative humidity of 70-100%, heat treating the pellets at a first temperature of 70-100° C until the free moisture content of the pellets is 2-5%, and adjusting to a second heat treatment temperature of from at least 100° to 900° C until the free moisture content of the pellets is 0.01 to 1.0% thereby obtaining a strengthened ore pellet product.

2. A method as claimed in claim 1, wherein, in the case of strengthening lumps from a charge with sulfur-bearing materials, the pellets, after heat-humidity treatment, are treated with an aqueous solution of chlorine bearing materials, and the second stage of heat treatment is effected at a temperature of at least 400° C to remove sulfur.

3. A method as claimed in claim 1, wherein, in the case of strengthening green pellets with an initial compression strength of less than 2.0 kg said pellets are, prior to the heat-humidity treatment, aged in air till the binder begins to set.

4. A method as claimed in claim 1, wherein, in the case of strengthening green pellets with an initial compression strength of less than 2.0 kg, said pellets are, prior to the heat humidity treatment, aged in a medium with a 90-100% relative humidity till the end of setting of said binder.

5. A method as claimed in claim 1, wherein, when use is made of a mineral hydraulic binder with a compression strength of less than 350-450 kg/$cm^2$ and aged for 28 days, said binder is, before being introduced into the charge, mechanically activated with the specific surface increasing by 10-15%.

* * * * *